US009108099B2

(12) United States Patent
Croft

(10) Patent No.: US 9,108,099 B2
(45) Date of Patent: Aug. 18, 2015

(54) PAD COVER

(75) Inventor: Neil David Croft, North Ringwood (AU)

(73) Assignee: Clads4Pads Pty Ltd., Melbourne, Victoria (AU)

( * ) Notice: Subject to any disclaimer, the term of this patent is extended or adjusted under 35 U.S.C. 154(b) by 0 days.

(21) Appl. No.: 13/395,259

(22) PCT Filed: Mar. 15, 2010

(86) PCT No.: PCT/AU2010/000305
§ 371 (c)(1),
(2), (4) Date: May 22, 2012

(87) PCT Pub. No.: WO2011/029124
PCT Pub. Date: Mar. 17, 2011

(65) Prior Publication Data

US 2012/0227162 A1 Sep. 13, 2012

(30) Foreign Application Priority Data

Sep. 11, 2009 (AU) ..... 2009904445

(51) Int. Cl.
*A63B 71/12* (2006.01)

(52) U.S. Cl.
CPC ..... *A63B 71/1225* (2013.01); *A63B 2071/125* (2013.01); *A63B 2071/1241* (2013.01); *A63B 2071/1258* (2013.01); *A63B 2243/0016* (2013.01)

(58) Field of Classification Search
CPC ..... D04B 1/243; D04B 1/18; D04B 9/46; A41B 11/14
USPC ..... 2/22, 23, 24
See application file for complete search history.

(56) References Cited

U.S. PATENT DOCUMENTS 3,784,985 A * 1/1974 Conroy ..... 2/22
3,854,228 A * 12/1974 Conroy ..... 36/71
4,001,953 A * 1/1977 Fugere et al. ..... 36/2 R
4,306,315 A * 12/1981 Castiglia ..... 2/22
4,665,562 A * 5/1987 Winer ..... 2/22
4,669,126 A * 6/1987 Jones ..... 2/22

(Continued)

FOREIGN PATENT DOCUMENTS

DE 41 25 634 2/1993
FR 2927772 8/2009

(Continued)

OTHER PUBLICATIONS

Williamson, Martin, "Cameras, lights and coral pink", http://www.cricinfo.com/worldseries/content/story/325202.html?wrappertype, published on Dec. 13, 2007 [retrieved on Apr. 15, 2010 per ISR—copy retrieved on Mar. 8, 2012] (3 pages).

(Continued)

*Primary Examiner* — Richale Quinn
(74) *Attorney, Agent, or Firm* — Quarles & Brady LLP

(57) ABSTRACT

A cover for a protective sport pad including a cover portion for covering a surface of the pad, and a fastening means for fastening the cover to the protective sport pad. In one form, the protective sport pad is a cricket pad for a lower leg portion of a player, and the cover portion is arranged to cover an exposed surface of the pad. The cover portion may be formed of colored material to change the color of the protective sport pad.

19 Claims, 9 Drawing Sheets

(56) References Cited

U.S. PATENT DOCUMENTS

| | | | | |
|---|---|---|---|---|
| 4,926,501 | A * | 5/1990 | Goosen | 2/22 |
| 5,093,931 | A * | 3/1992 | LaBerge et al. | 2/22 |
| 5,628,063 | A * | 5/1997 | Reed | 2/22 |
| 5,715,535 | A * | 2/1998 | Hamilton et al. | 2/59 |
| 5,733,249 | A * | 3/1998 | Katzin et al. | 602/21 |
| D395,158 | S * | 6/1998 | Lindaman | D2/986 |
| 5,784,715 | A * | 7/1998 | Buchanan | 2/22 |
| 6,024,714 | A * | 2/2000 | Katzin | 602/62 |
| 6,374,408 | B1 | 4/2002 | Tomlinson et al. | |
| 7,237,270 | B2 * | 7/2007 | Crye et al. | 2/24 |
| 7,578,800 | B2 * | 8/2009 | Castillo et al. | 602/23 |
| 2008/0222765 | A1 * | 9/2008 | Brandt | 2/22 |

FOREIGN PATENT DOCUMENTS

| | | |
|---|---|---|
| GB | 955486 | 4/1964 |
| WO | WO 2007/127343 | 11/2007 |

OTHER PUBLICATIONS

Baker, Richard, "International Search Report", International Application No. PCT/AU2010/000305, mailed on May 10, 2010 (6 pages).

* cited by examiner

PAD COVER

FIELD OF THE INVENTION

This invention relates to a pad cover, and more particularly, but not exclusively, to a coloured cover for a cricket batting or wicket-keeping pad.

BACKGROUND OF THE INVENTION

Protective sports pads are well known, and are commonly used in sports such as cricket, hockey, and the like. The applicant has determined that there exists a problem as there is considerable expense in purchasing different sets of protective sports pads in different team colours. More specifically, recent changes necessitate local cricket clubs to purchase sets of cricket batting/wicket-keeping pads in different colours to match the different coloured uniforms worn by the cricket teams when playing in competition, representing a large expense to these clubs.

The applicant has determined that it would be beneficial for there to be some alternative to purchasing several sets of coloured cricket pads so as to save the expense involved in purchasing more than a single set of cricket pads which are relatively costly items. It has also been identified that, although the present invention is particularly applicable to cricket pads, it may also be used with other protective sporting pads.

Examples of the present invention seek to provide a cover for protective sport pads which overcomes or at least alleviates one or more disadvantages of existing protective sport pads.

SUMMARY OF THE INVENTION

In accordance with one aspect of the present invention, there is provided a cover for a protective sport pad including a cover portion for covering a surface of the pad, and a fastening means for fastening the cover to the protective sport pad.

Preferably, the protective sport pad is a cricket pad for a lower leg portion of a player. More preferably, the cover portion is arranged to cover an exposed surface of the pad. Even more preferably, the cover portion is formed of coloured material to change the colour of the protective sport pad.

In a preferred form, the cover portion is arranged to substantially cover an entire frontal surface of the cricket pad.

Preferably, the cover is in the form of a sleeve for fitting in sleeved arrangement over the cricket pad. More preferably, the cover has a hood for covering one end of the cricket pad, and a fastener on a rear of the cover for fastening the hood at a rear side of the cricket pad.

Preferably, the cover has a plurality of apertures located on opposed side edges of the cover for allowing straps of the cricket pad to be fed through the apertures for attachment of the cricket pad top the player's lower leg with the cover in place.

The cover may be formed of stretchable material.

In accordance with another aspect of the present invention, there is provided a cricket pad when fitted with a cover as described above, to change the colour of the protective sport pad.

In accordance with yet another aspect of the present invention, there is provided a method of covering a protective sport pad, including the steps of:

fitting a cover over the sport pad to cover a surface of the pad; and feeding securing straps of the sport pad through apertures formed in the cover.

Preferably, the protective port pad is a lower leg cricket pad, and the method includes the steps of:

fitting the cover in sleeved arrangement over one end of the cricket pad;

covering an opposite end of the cricket pad with a hood of the cover; and fastening the hood to a rear section of the cover at a rear side of the cricket pad.

In accordance with still another aspect of the present invention, there is provided a method of covering a protective sport pad, including the step of changing the colour of the sport pad by fitting a coloured cover to the sport pad.

BRIEF DESCRIPTION OF THE DRAWINGS

The invention is described, by way of non-limiting example only, with reference to the accompanying drawings in which.

DETAILED DESCRIPTION

Figure 1:
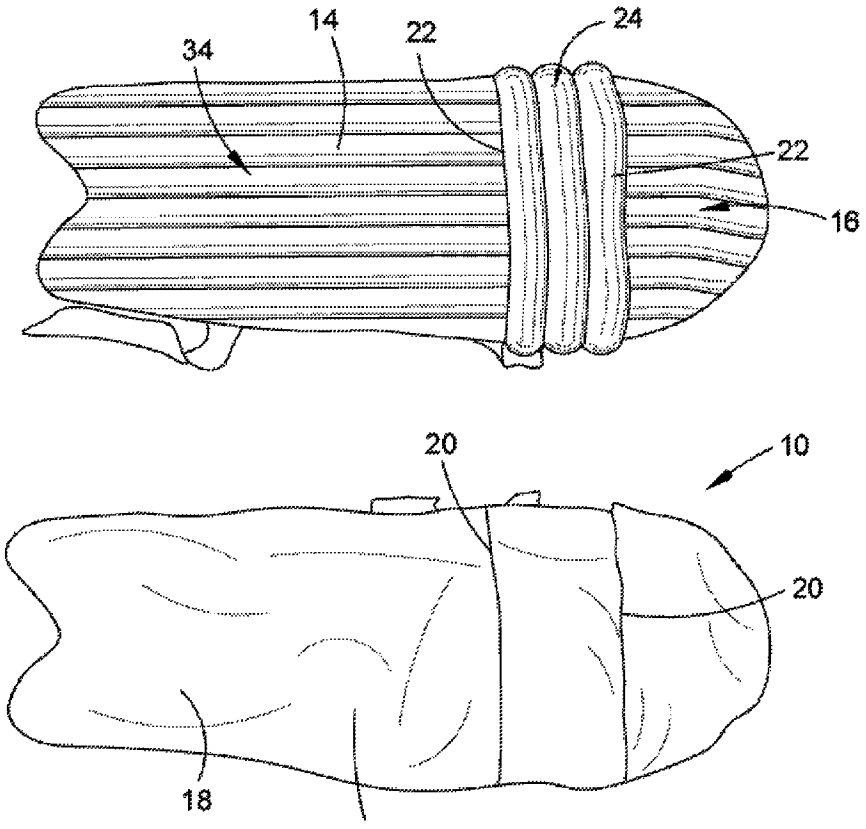
FIG. 1 is a front view of a cricket pad shown alongside a cover for the cricket pad, in accordance with an example of the present invention.
Figure 2:
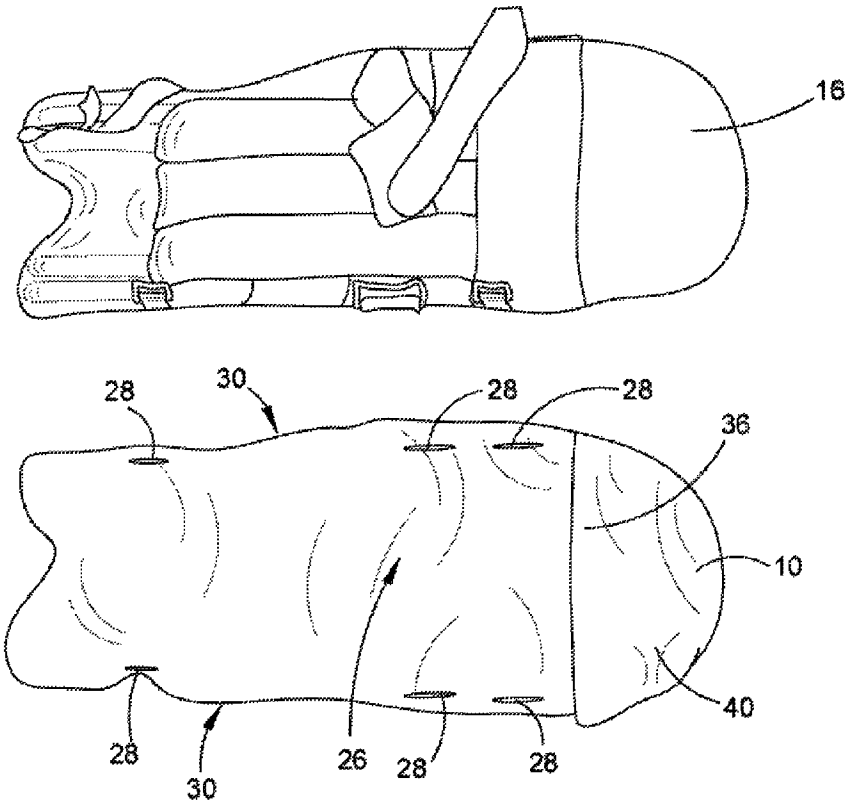
FIG. 2 is a rear view of the cricket pad and cricket pad cover of FIG. 1.

With reference to FIGS. 1 to 9 of the drawings, a cover 10 in accordance with an example of the present invention includes a cover portion 12 for covering a surface 14 of a cricket pad 16. Although the cricket pad 16 shown in the drawings is in the form of a cricket batting pad, it will be understood that other embodiments of covers in accordance with the present invention may be used with cricket wicket-keeping pads, or other types of protective sport pads. In the example shown, the cover 10 is formed of red coloured material so as to change the colour of the cricket pad 16 which is predominantly white. Advantageously, several sets of covers such as covers 10*a*, 10*b*, 10*c* may be purchased in different colours and may be fitted to cricket pads to change the colour of the cricket pads, as required for meeting uniform colour requirements of the cricket team. The availability of the cover 10 may represent a considerable saving to a cricket club, as it is foreseen that it will be significantly less expensive to purchase covers in various different colours than to purchase a separate set of cricket pads in each different colour.

With reference to FIG. 1, the cover 10 is shaped generally with the same shape as the cricket pad 16 so as to facilitate fitment of the cover 10 to the cricket pad 16, and to provide a neat appearance of the cover 10 when fitted to the cricket pad 16. A front portion 18 of the cover 10 may have seams 20 at locations which correspond to upper and lower borders 22 of a horizontally ribbed section 24 of the cricket pad 16. The front portion 18 is sewn around its perimeter to a rear portion 26 of the cover 10, with apertures 28 being left on opposed side edges 30 for allowing straps 32 of the cricket pad 16 to be fed through the apertures 28, thus allowing attachment of the cricket pad 16 to the player's lower leg with the cover 10 in place.

In the example shown, the cover portion 12 covers both front and rear sides of the cricket pad 16, however in alternative examples, the cover portion 12 may be configured to cover only an exposed frontal surface 34 of the cricket pad 16, with a rear side of the cover 10 being left substantially open in an arrangement similar to that of a fitted bed sheet, to facilitate use of the fastening straps 32. In the example shown, the cover 10 includes fastening means in the form of a fastening strip 36 which fastens the cover 10 together at an upper part of the rear portion 26, above the apertures 28. The fastening strip 36 may be of a hook-and-loop type arrangement, or may use other forms of fasteners.

Figure 3:
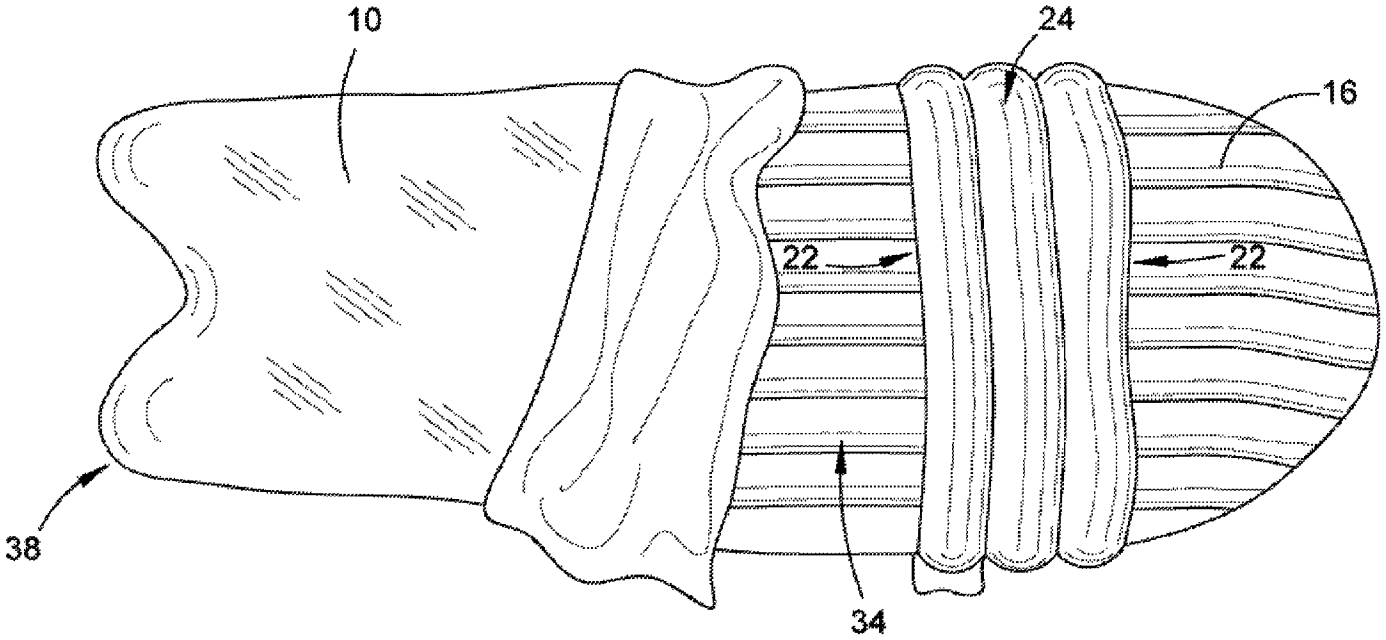
FIG. 3 shows a front view of the cover being fitted in sleeved arrangement over the cricket pad.

With reference to FIG. 3, the cover 10 is shown being slid over a lower end of the cricket pad 16. The cover 10 is formed of stretchable material to facilitate fitment of the cover 10 to the cricket pad 16, and to provide an attractive taut appearance. The cover 10 is indented at a lower end thereof to fit with the lower end 38 of the cricket pad 16 which is indented to accommodate the foot of the player.

Figure 4:
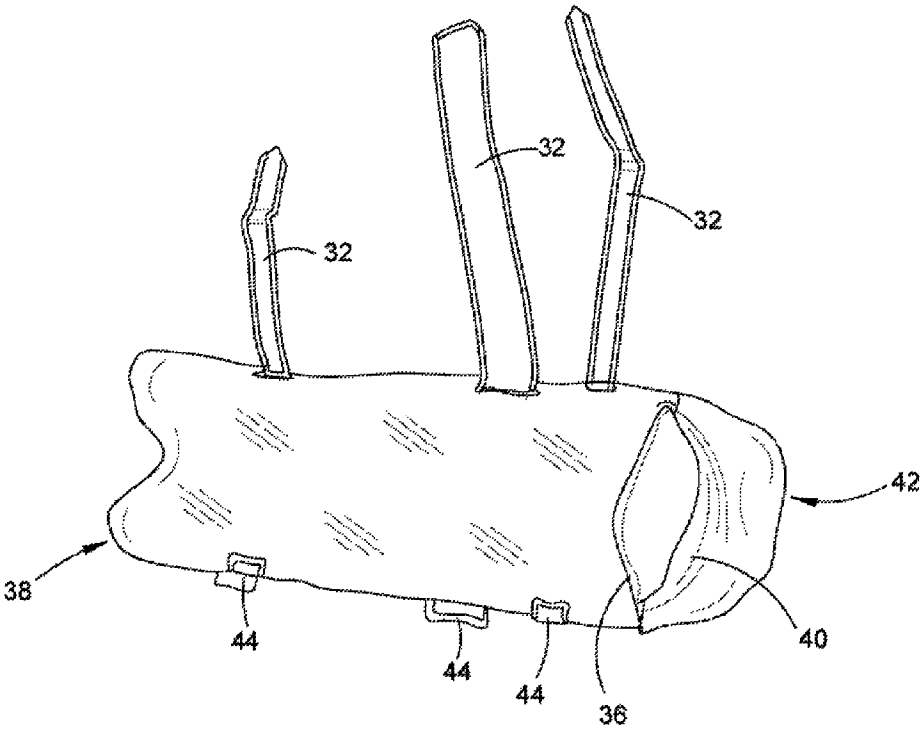
FIG. 4 shows a rear view of the cover when fitted to the cricket pad, prior to fastening of a hood of the cover.
Figure 5:
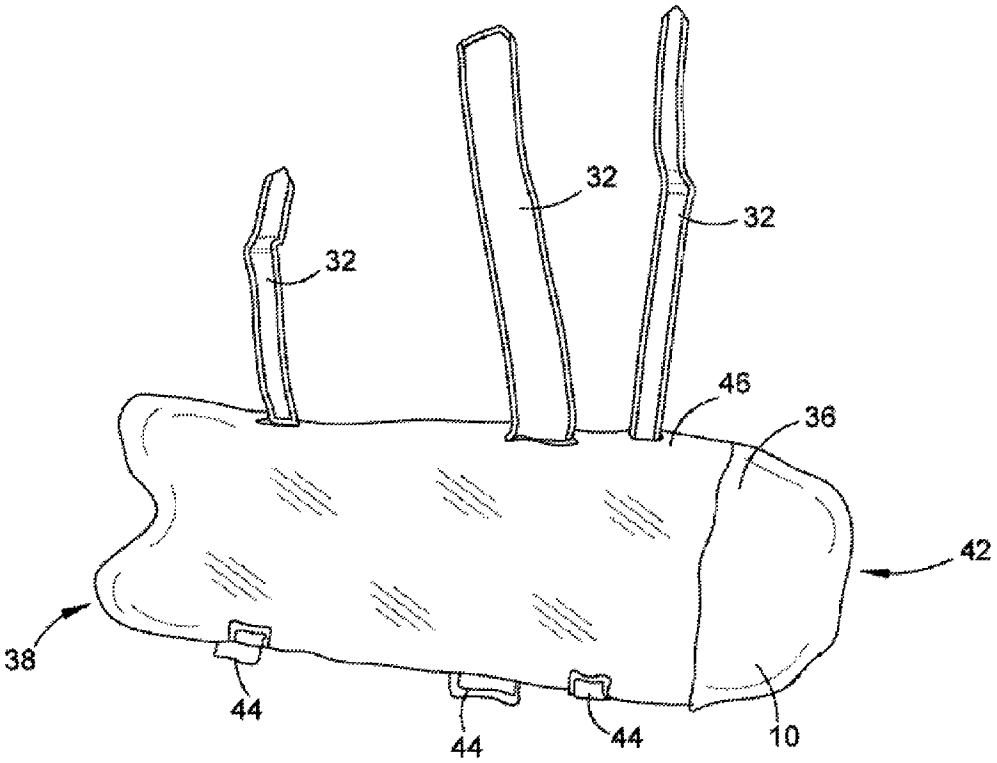
FIG. 5 shows a rear view of the cover when fitted to the cricket pad, after fastening of the hood.

As shown in FIG. 4, once the cover 10 is slid over the length of the cricket pad 16, a hood 40 of the cover 10 is slipped over an upper end 42 of the cricket pad 16, and the straps 32 are fed through the apertures 28. More specifically, on one side edge 30 of the cover 10 the straps 32 are fed through the apertures 28, and, at an opposite side edge 30 loops 44 are fed through the apertures 28. Once the straps 32 and loops 44 have been fed through the apertures 28, the hood 40 is fastened to a lower part 46 of the rear portion 26 by fastening the fastening strip 36, as shown in FIG. 5.

Figure 6:
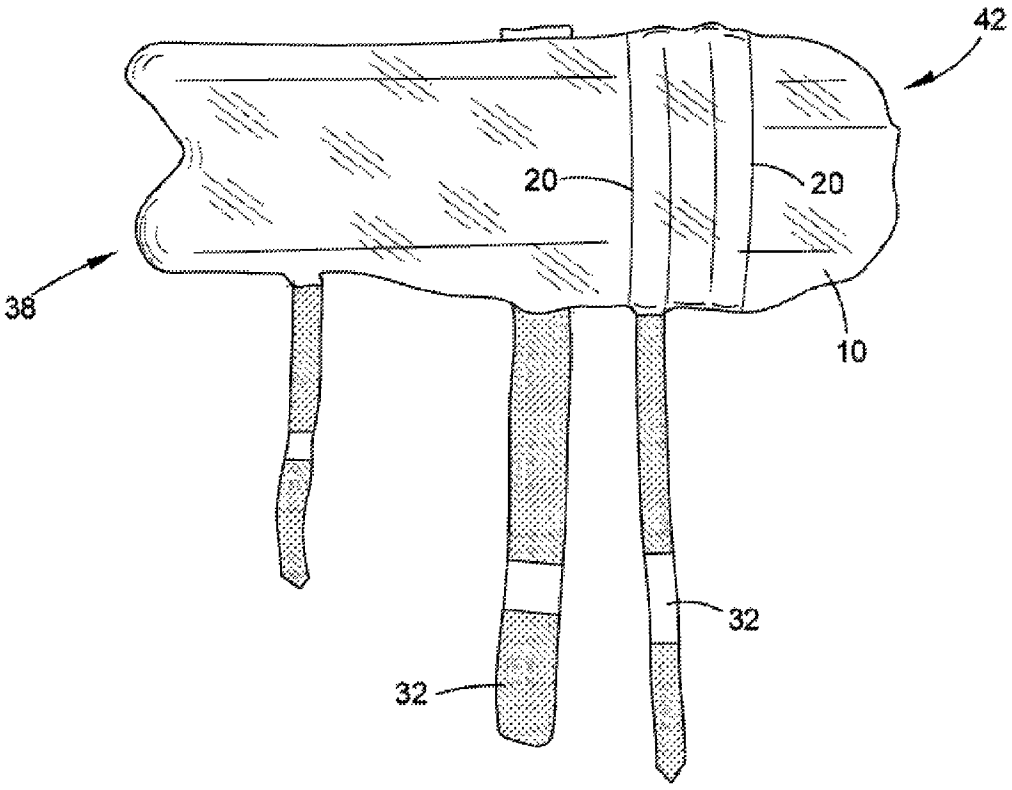
FIG. 6 shows a front view of the cover when fitted to the cricket pad.
Figure 7:
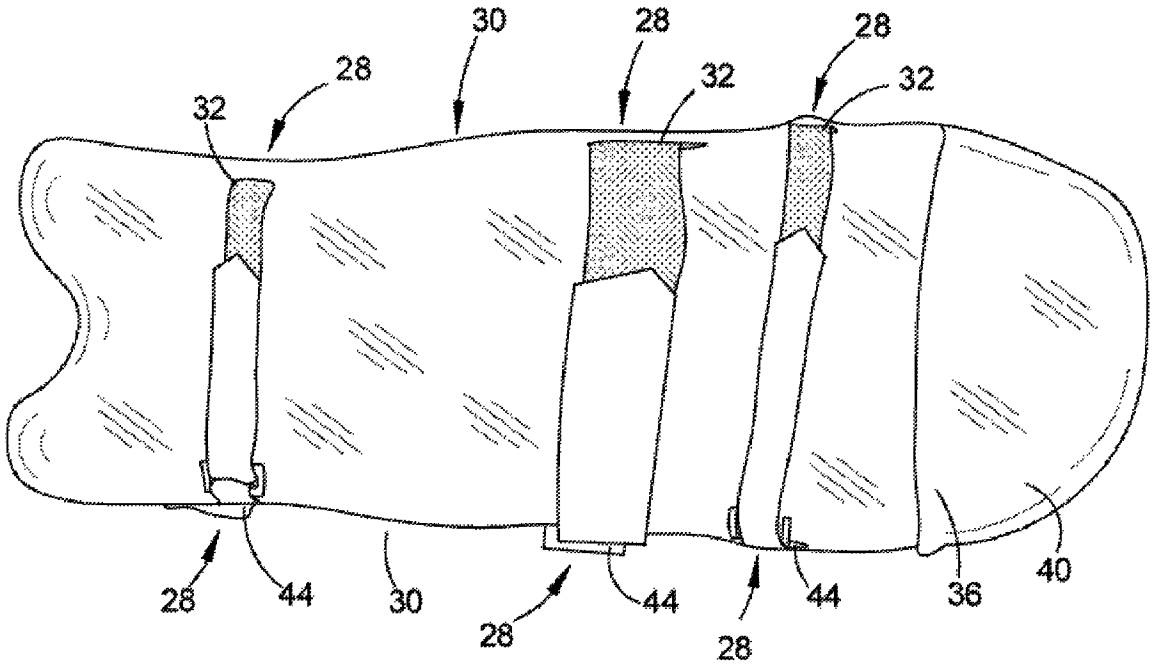
FIG. 7 shows a rear view of the cover when fitted to the cricket pad, with fastening straps of the cricket pad fastened.

FIG. 6 shows the cover 10 fitted to the cricket pad 16, with the straps 32 unfastened, and in this configuration the cricket pad 16 is ready for attachment to the lower leg of the player by fitting the straps 32 through the corresponding loops 44 in the usual manner. FIG. 7 shows a rear view of the cover 10 fitted to the cricket pad 16, with the straps 32 in the fastened arrangement wherein they are fed through the corresponding loops 44 and folded back over themselves where they are fastened by way of hook-and-loop type fasteners.

Figure 8:
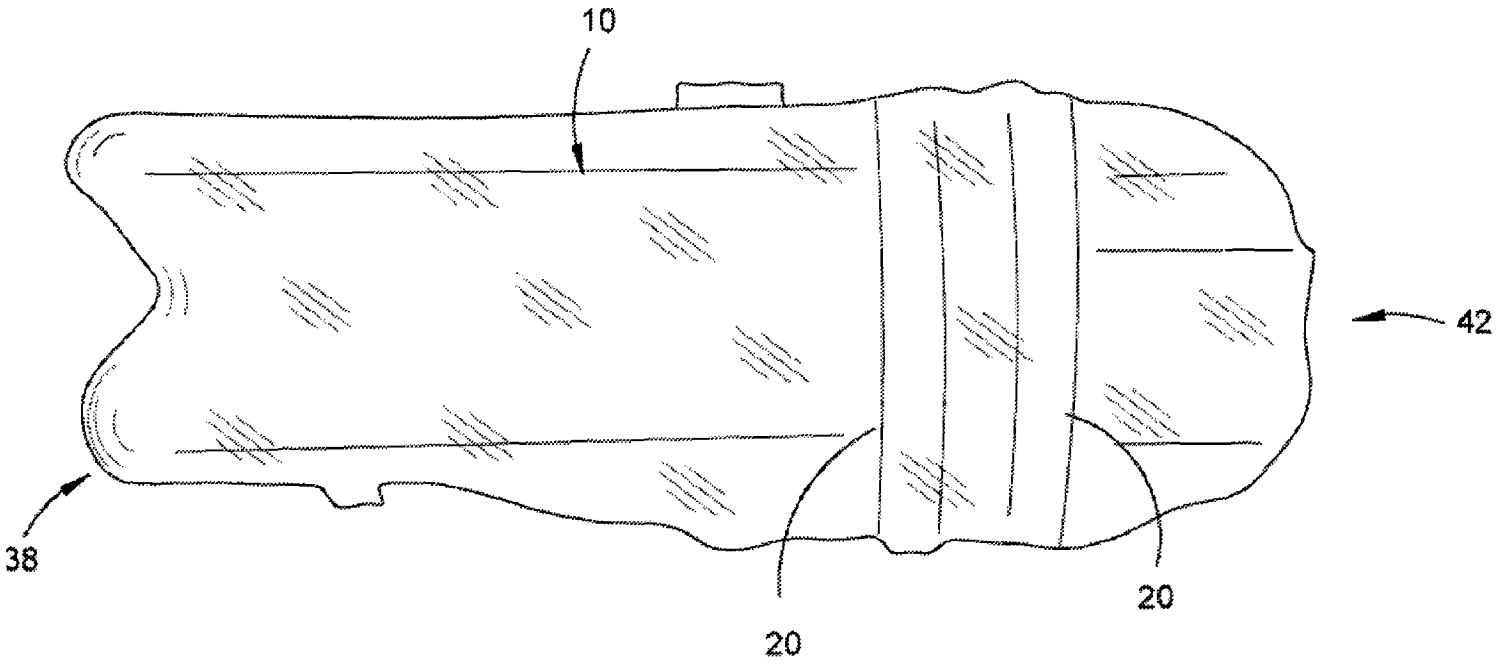
FIG. 8 is a front view of the cover when fitted to the cricket pad.
Figure 9:
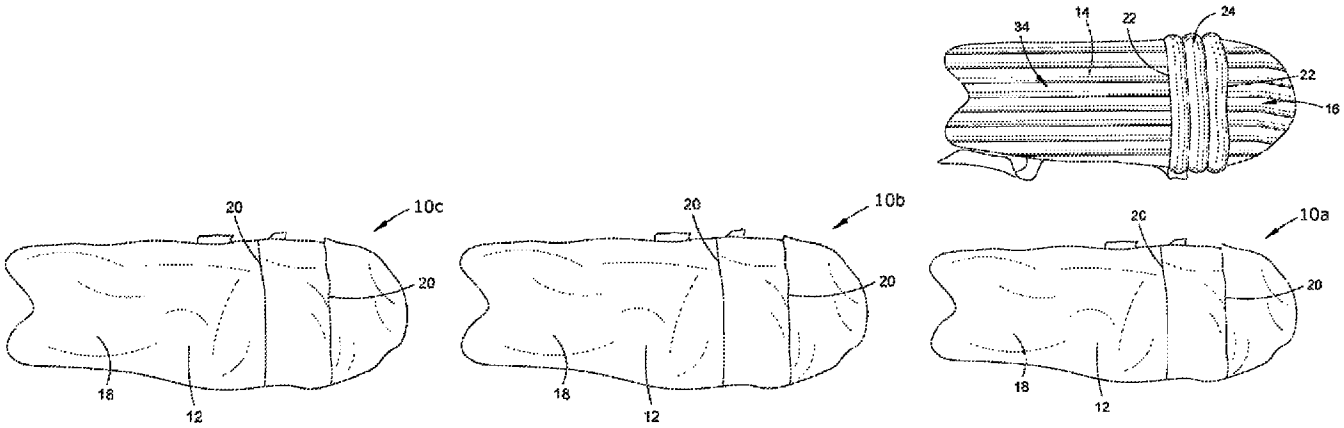
FIG. 9 is a front view of a cricket pad shown alongside a plurality of removable, interchangeable covers for the cricket pad.

As can be seen in FIG. 8, the cover 10 enables the colour of the cricket pad 16 to be changed in a cost effective and attractive manner. The taut fit of the cover 10 assists in avoiding any interference of the cover 10 with the normal operation of the pad 16. In addition to the advantages in facilitating inexpensive change of colour of a single set of cricket pads, the cover 10 also provides a protective covering to the cricket pad 16 such that the cricket pad 16 beneath remains relatively clean, and the cover 10 can be removed and easily washed in the event that it gets soiled. It has also been identified that the cover may be used for sponsorships/endorsements. More specifically, in competitions where advertising is permissible, the covers may be used for advertising space.

Other advantages of the cover include the transport ability of the covers in that they are light weight and compact when removed from the cricket pads, eliminating the need to carry additional sets of coloured cricket batting pads. Furthermore, the pad covers would also save a cricket club expense if the club changes its colours, in which case new coloured covers can be purchased rather than additional cricket batting pads.

Although the covers may be provided in material which is sufficiently stretchable to provide a universal fit, it is foreseen that they will be provided in different sizes such as, for example, junior, intermediate, senior and wicket keeping sizes. The covers may be provided in a range of colours, including red, blue, green and black, and may be tailored to suit each particular case with the choice of colour and/or logo(s)/advertising.

In one alternative example, the front portion 18 of the cover 10 is formed of a relatively strong material to protect the front of the cricket pad 16 from damage from impacts of cricket balls and the like, whereas the rear portion 26 of the cover 10 is formed of a relatively stretchable material to facilitate fitment of the cover 10 to the cricket pad 16. The front portion 18 may be joined to the rear portion 26 by one or more seams which are located inside of the rear of the cricket pad 16 when fitted to the pad 16. In this way, the interface between the front portion 18 and the rear portion 26 is hidden from view when the cricket pad 16 is worn, and the cover 10 may be fitted to cricket pads 16 of different widths without the interface being displayed. In particular, the applicant has identified that different brands of cricket pad are manufactured with different widths, and therefore the cover 10 may be used with different brand cricket pads without displaying the interface between the front portion 18 and the rear portion 26. The apertures 28 may be reinforced with sewing around the apertures 28.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The claims defining the invention are as follows:

1. At least one removable cover configured to be used with a protective sport pad worn by a player during sport for selectively adapting the protective sport pad to a colouring of a sport team, the protective sport pad having an outer surface facing away from the player and visible when the protective sport pad is worn normally by the player without the at least one removable cover, the outer surface being of a first colouring, the at least one removable cover including:

a cover portion which is coloured with a second colouring different to the first colouring, the at least one removable cover configured to be fitted to the protective sport pad so as to be carried by the protective sport pad, such that the cover portion covers all of the outer surface of the protective sport pad such that the outer surface of the protective sport pad is no longer visible thereby adapting an external appearance of the protective sport pad when worn to at least substantially conform to the colouring of the sport team, wherein the at least one removable cover includes a fastener for releasably fastening the at least one removable cover around the protective sport pad, wherein the at least one removable cover has at least one aperture located on each of opposed side edges of the at least one removable cover, wherein the at least one removable cover is formed of stretchable material such that the at least one removable cover stretches to fit protective sport pads of different dimensions; and wherein the at least one removable cover is configured to have generally a same shape as the protective sport pad.

2. The at least one removable cover of claim 1, wherein the protective sport pad is a cricket pad for a lower leg portion of a player.

3. The at least one removable cover of claim 2, wherein the protective sport pad is a cricket batting pad.

4. The at least one removable cover of claim 2, wherein the protective sport pad is a cricket wicket-keeping pad.

5. The at least one removable cover of claim 2, wherein the cover portion is arranged to cover an exposed surface of the protective sport pad.

6. The at least one removable cover of claim 5, wherein the cover portion is formed of coloured material to change the colour of the protective sport pad.

7. The at least one removable cover of claim 5, wherein the cover portion is arranged to substantially cover an entire frontal surface of the protective sport pad.

8. The at least one removable cover of claim 2, wherein the at least one removable cover is in the form of a sleeve for fitting in sleeved arrangement over the protective sport pad.

9. The at least one removable cover of claim 8, wherein the at least one removable cover has a hood for covering one end of the protective sport pad, and a fastener on a rear of the at least one removable cover for fastening the hood at a rear side of the protective sport pad.

10. The at least one removable cover of claim 2, wherein the at least one aperture is a plurality of apertures located on opposed side edges of the at least one removable cover for allowing straps of the protective sport pad to be fed through the apertures for attachment of the protective sport pad to the player's lower leg with the at least one removable cover in place.

11. The at least one removable cover of claim 1, wherein the cover portion of the at least one removable cover is formed of a relatively strong material and a rear portion of the at least one removable cover is formed of the stretchable material.

12. The at least one removable cover of claim 1, wherein the protective sport pad is a cricket pad and the cricket pad is fitted with the at least one removable cover to change a colour of the cricket pad.

13. The at least one removable cover of claim 2, wherein the at least one removable cover is configured to allow normal operation of straps of the protective sport pad with the at least one removable cover in place on the protective sport pad.

14. The at least one removable cover of claim 1, wherein the at least one removable cover comprises a plurality of removable covers, wherein the plurality of removable covers are interchangeable, and wherein each removable cover of the plurality of removable covers has a different colouring for adapting the protective sport pad to a range of sport team colourings.

15. A method of covering a protective sport pad, including the steps of:

providing a removable cover having a cover portion which is coloured with a second colouring different to a first colouring of the protective sport pad, fitting the removable cover over the protective sport pad to cover an outer surface of the protective sport pad; and feeding securing straps of the sport pad through apertures formed in the cover;

wherein the cover portion covers all of the outer surface of the protective sport pad such that the outer surface of the protective sport pad is no longer visible thereby adapting an external appearance of the protective sport pad when worn to at least substantially conform to the colouring of a sport team, wherein the removable cover is formed of stretchable material such that the removable cover stretches to fit protective sport pads of different dimensions;

wherein the removable cover has at least one aperture located on each of opposed side edges of the removable cover, and wherein the removable cover is configured to have generally a same shape as the protective sport pad.

16. The method of covering a protective sport pad as claimed in claim 15, wherein the protective port pad is a lower leg cricket pad, the method including the steps of:

fitting the removable cover in sleeved arrangement over one end of the lower leg cricket pad;

covering an opposite end of the lower leg cricket pad with a hood of the removable cover; and fastening the hood to a rear section of the removable cover at a rear side of the lower leg cricket pad.

17. A method of covering a protective sport pad, including the steps of:

providing a removable cover having a coloured cover portion which is coloured with a second colouring different to a first colouring of the protective sport pad, and changing the colour of the protective sport pad by fitting the coloured cover portion to the protective sport pad;

wherein the coloured cover portion covers all of the outer surface of the protective sport pad such that the outer surface of the protective sport pad is no longer visible thereby adapting an external appearance of the protective sport pad when worn to at least substantially conform to the colouring of a sport team, wherein the removable cover is formed of stretchable material such that the removable cover stretches to fit protective sport pads of different dimensions;

wherein the removable cover has at least one aperture located on each of opposed side edges of the removable cover, and wherein the removable cover is configured to have generally a same shape as the protective sport pad.

18. A removable cover adapted to be fitted to a protective sport pad usable without the cover so as to be carried by the protective sport pad, the cover comprising:

a cover portion which is coloured and arranged for covering a front surface of the protective sport pad for adapting an appearance of the protective sport pad to at least substantially conform to a colour of a sport team; and a fastener for releasably fastening the removable cover around the protective sport pad;

wherein the removable cover is formed of material sufficiently stretchable to allow the removable cover to stretch to fit protective sport pads of different dimensions;

wherein the removable cover has at least one aperture located on each of opposed side edges of the removable cover, and wherein the removable cover is configured to have generally a same shape as the protective sport pad.

19. The cover of claim 18, wherein the cover portion is arranged for covering a front surface of a cricket pad.

* * * * *